United States Patent [19]

Rosen et al.

[11] 4,005,703

[45] Feb. 1, 1977

[54] VIBRATORY MASSAGE THERAPEUTIC DEVICE

[76] Inventors: Arnold Rosen, 580 Christie St., Apt. 510, Toronto, Ontario, Canada, M6G3E3; William Harvey Harris, 2641 Widemarr Road, Mississauga, Ontario, Canada, L5J1M4

[22] Filed: June 4, 1975

[21] Appl. No.: 583,520

[52] U.S. Cl. ..... 128/33; 128/41

[51] Int. Cl.[2] ..... A61H 1/00

[58] Field of Search ..... 128/24.1, 24.2, 33, 128/41

[56] References Cited

UNITED STATES PATENTS

| | | | |
|---|---|---|---|
| 3,037,499 | 6/1962 | Cummins | 128/33 |
| 3,053,250 | 9/1962 | Stubbs | 128/41 |
| 3,075,101 | 1/1963 | Neff | 128/41 X |
| 3,096,758 | 7/1963 | Savage | 128/41 |
| 3,220,405 | 11/1965 | Bross | 128/24.1 |

*Primary Examiner*—Lawrence W. Trapp

[57] ABSTRACT

A vibratory therapeutic cushion using multiple vibrator units enclosed in a flexible supple cushion, in a blanket-like pad or in a seat, each vibratory unit composed of an electrical coil slidably mounted in a magnetic field of a permanent magnet, the coil being supplied by an electrical oscillator with alternating electrical current or pulses of current at selectable magnitudes and frequencies, inducing vibrations in the coil which are transmitted to plates, one attached to the magnet assembly and one to the coil. The plates transmit the vibrations to the enclosure. The combination of vibrator units distributed in the seat produce uniformly distributed vibrations of desired intensity and frequency to vibrate the skin, muscles or internal organs as desired.

6 Claims, 10 Drawing Figures

VIBRATORY MASSAGE THERAPEUTIC DEVICE

FIELD OF THE INVENTION

Figure 1A:
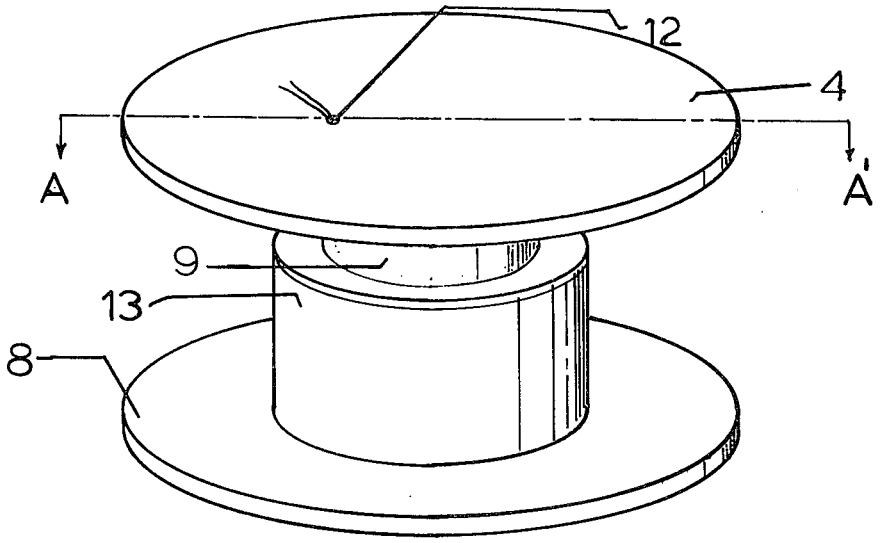

This invention relates to electrical vibrator massage therapeutic devices and electronic oscillators.

OBJECTS OF INVENTION

The principal object of this invention is to provide a new and improved electrically operated vibrator and vibrator cushions for producing vibration used in producing therapeutic massage and muscle relaxation.

Other principal objects is to provide a vibrator cushion employing a plurality of vibrator units operating at preselectable frequencies and magnitude of vibration that is capable of battery operation and is installable in motor vehicles as supplementary cushions or built into foam cushioned seats in such vehicles.

Another object is to provide vibrator cushions of flexible soft material such as foam, plastic or rubber embedded within which are a plurality of vibrator units arranged to provide local or uniform vibrations over the surface of the cushion, the vibratory units being compact enough to permit thin cushions as desired, and also permitting the cushions to be made into seat-sized units covering either lower or entire seat occupied by a person or large enough to be made into bedsized mats of uniform thickness which can be rolled up for portability.

Other objects include providing a vibratory massage device within which the vibrator units can be individually or multiply connected to concentrate or disperse vibrations as desired.

Another object is to provide a vibratory device which can be supplied operational power by battery for portability or by household alternating electrical power as desired.

Another object is to provide an electrical vibratory device which is excited by an electrical power supply which electrical output to the vibratory device can be an oscillating or pulsating periodic voltage, the oscillation or pulsation frequency of which and the magnitude of which can be selected by the user, so as to provide varying degrees of vibratory penetration into the body and at varying magnitudes of force, as desired.

FEATURES OF THE INVENTION

The principal feature of this invention resides in the adaptability of the vibrator units employed in vibrator cushions, chairs and the like to a wide number of different embodiments with little or no change in the basic vibrator Another feature resulting from the small size light weight and low power consumption of each vibrator unit is the thinness with which cushions and mats carrying the vibrator units can be made and the flexibility of these cushions and mats permitting easy portability and portable operation by means of batteries for instance.

Another feature of the invention lies in the distribution of the vibrator units throughout the cushion or mat to provide even distribution of vibrations or to concentrate vibrator units in predetermined areas of such cushions or mats to achieve concentrated massage effects as desired. Electrical switching of individual units can be provided in cushions or mats having a plurality of vibrator units to achieve varying locations of vibratory activity of the cushion or mat and varying concentrations of vibratory activity as desired by the user. This can be done by providing switching means on the electrical power supply to direct electricity to the desired vibrator units as required.

Another feature of the invention resides in the means of excitement of the vibrator units by the electrical power supply which may derive its power source from batteries or rectified household electricity as required. The electrical power supply is adapted to produce an electrical voltage output that varies in a predetermined fashion.

The electrical power supply is adapted to produce a periodically varying voltage output, the frequency of which is selectable by control means, such control means varying the resonant frequency of the power supply from 3 to 200 cycles per second. Similarly sinusoidally varying voltage generated by an electronic oscillator similar to an audio oscillator, or a periodic pulsating voltage generated by an electronic astable multivibrator may be used to excite the vibrator units into mechanical oscillation at the frequency of the voltage variation, such vibrator units being similar to those powering conventional audio speakers.

The magnitude of the electrical output of the power supply is preselectable by control means which are integral with the power supply. The magnitude of the electrical output supplied to the vibrator units controls the magnitude of mechanical oscillation of the vibrator units, a higher voltage output increasing the magnitude of the mechanical vibrations.

The user selects the magnitude of mechanical oscillation by means of the voltage control means of the power supply to achieve the desired therapeutic effects.

The feature of variable vibration frequency produced by the variable frequency of electrical voltage induced by the electrical power supply permits the user to select the most suitable frequency for vibrational penetration of the body tissues; the lower frequencies near three cycles per second providing deep penetration of the vibrational energy into the body and muscles, higher frequencies being useful for inducing therapeutic effects nearer the skin surface.

These and other objects and features appear in the following description to be read in conjunction with the drawings.

DRAWINGS

FIG. 1*a* is a perspective view of a vibrator unit taken from a point above and to one side, illustrating the arrangement of mechanical excitation plates and outer stator housing.

Figure 1B:
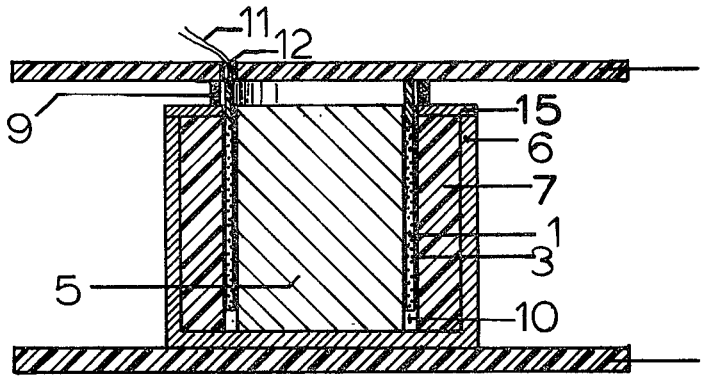

FIG. 1*b* is a view in vertical cross section of a vibrator unit taken along lines A—A of FIG. 1*a*.

Figure 1C:
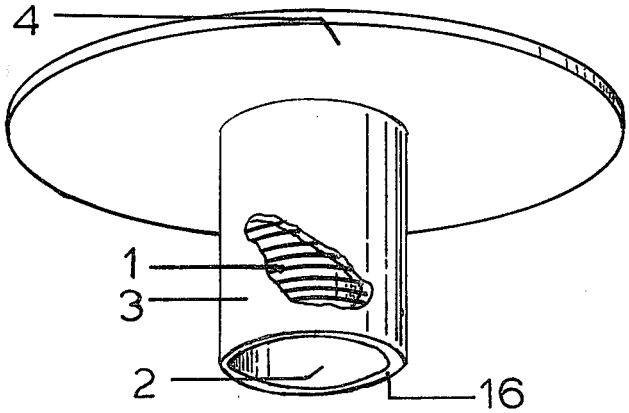

FIG. 1C is a perspective view from below and to one side of the excitation plate which is mounted on the excitation coil retaining tube.

Figure 1D:
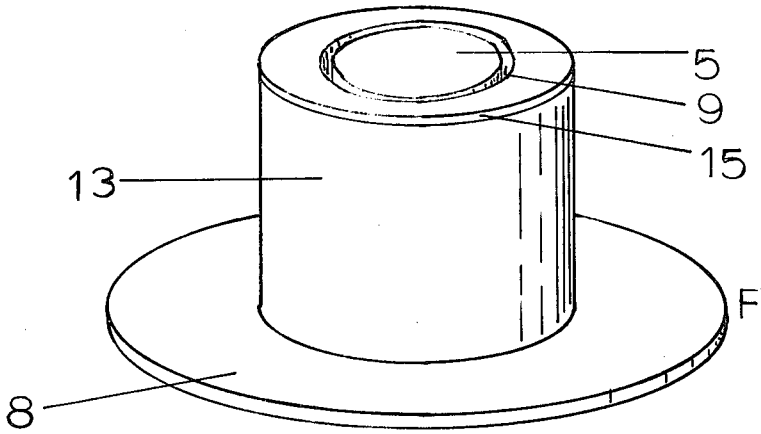

FIG. 1*d* is a perspective view of the stator of a vibrator unit from above and to one side.

Figure 2A:
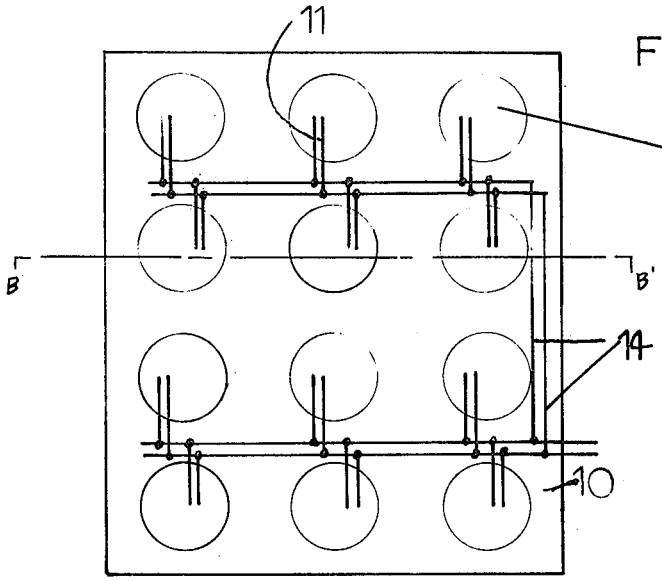

FIG. 2*a* is a plan view of a mat in which vibrator units have been embedded, showing the hidden units.

Figure 2B:
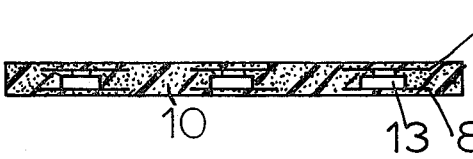

FIG. 2*b* is a vertical cross-sectional view of the above mat taken along line B—B of FIG. 2*a*.

Figure 3A:
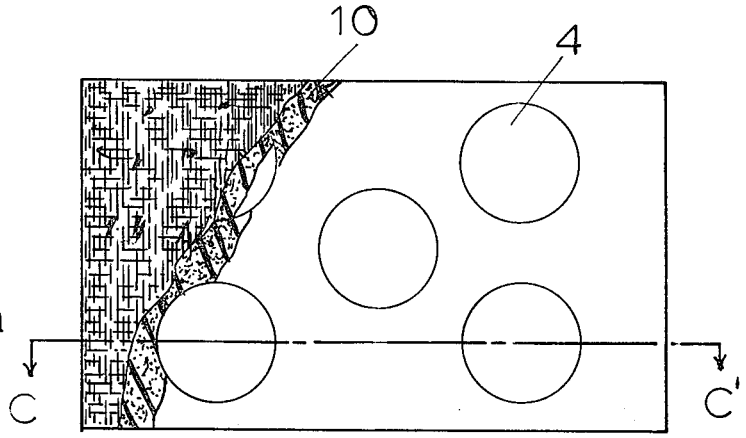

FIG. 3*a* is a plan view of a cushion in which vibrator units have been embedded, showing the hidden units.

Figure 3B:
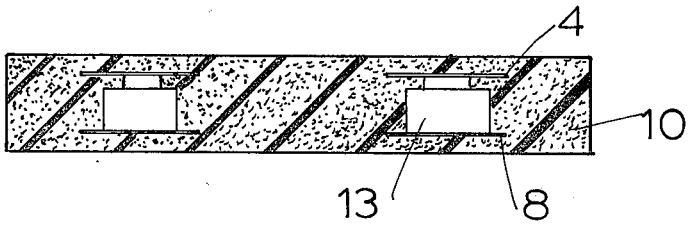

FIG. 3*b* is a vertical cross-sectional view of the above cushion taken along line C—C′ of FIG. 3*a*.

Figure 4B:
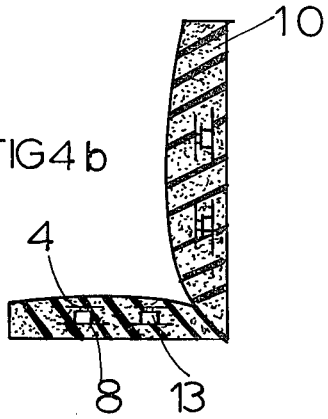
Figure 4A:
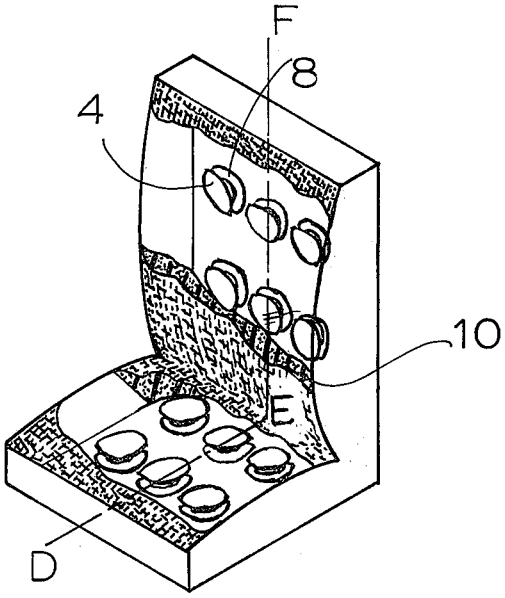

FIG. 4*a* is a perspective view of a cushioned seat in which a number of vibrator units have been embedded.

FIG. 4*b* is a vertical cross-sectional view of the above seat taken along the plane occupied by lines D-E-F.

DESCRIPTION OF THE INVENTION

One embodiment of a vibrator unit of the invention is disclosed in FIGS. 1*a*, 1*b*, 1*c*, 1*d* FIGS. 2*a*, *b*, 3*a*, *b*, 4*a*, *b*, depict typical embodiments of a mat, cushion and seat incorporating a multiplicity of vibrator units.

Referring to FIGS. 1*a*, 1*b* and 1*c*, 1*d* which show a vibrator unit, in the driver coil assembly (16) the driving coil (1) of insulated electrical wire having multiple windings is wound around a rigid hollow cylindrical tube (2) the inside surface of which is smooth self-lubricating such as a plastic or other material having low friction qualities. The driving coil embedded in any suitable plastic casting material 3 has a smooth outer surface which is lubricated or which possesses self-lubricating properties.

The cylindrical tube is mounted rigidly at right angles to the underside of a mechanical excitation plate 4 which may be round or shaped as desired and is larger than the stator casing 6 and is substantially the same size as the mechanical excitation plate 8 which is rigidly mounted to the stator case. Electrical power is transmitted to the driving coil through lead-in wires 11 passing through aperture 12 in the mechanical excitation plate 4.

The stator 13 is constructed of a cylindrical permanent magnet 5 the magnetic poles of which are at the ends of the magnet. The magnets' horizontal diameter is slightly smaller than tube 2 permitting a free sliding movement. This magnet is affixed to a magnetically permeable stator casing 6 such as a suitable iron alloy. The casing is tubular being substantially circular in horizontal cross section, completely enclosing the magnet at its lower end.

The casing 13 is closed at its upper end by a circular washer-like cover plate 15 of magnetically permeable material the hole 14 of which is sufficiently large to permit the driver coil assembly 16 to pass freely through permitting a low friction vertical sliding movement. The cover plate 15 is affixed the stator casing at the upper edges thereof.

A liner 7 of material having low friction qualities such as a suitable plastic occupies the interior of the stator. This filler 7 has a vertical cylindrical bore 10 of approximately the same size of the cover plate hole 14 and is aligned therewith to permit easy sliding of the driver coil assembly within.

In the assembled vibrator unit, the driver coil assembly as viewed in Diagram 1*c* is mounted on the stator assembly and separated therefrom by a ring 9 of resilient material such as rubber as indicated in Diagrams 1*b*, 1*d*.

The ring is fastened to the underside of the light weight rigid mechanical excitation plate 4 and to the cover plate 15 so as to maintain the integrity of the vibrator unit preventing separation of parts 4 and 15 and also keeping the two parts in alignment for easy movement, and preventing undue strain on the parts from excessive exterior pressure.

In the alternative to the stator described and depicted above, a conventional speaker unit of the open stator housing construction may be used. In this, the stator housing is formed of a bent plate of magnetically permeable metal and does not completely enclose the magnet. Around the magnet is a tube enclosing the vibrating coil supporting tube, this former tube for use in this invention must be of low friction material or lubricated to provide alignment for the vibrating coil supporting tube and yet allow free movement longitudinally.

The length of the coil tube should be less than that of the height of the magnet. The height of the magnet should be sufficient to bring its top surface approximately flush with the surface of the cover plate. The hole of the cover plate should be small enough to maintain a strong magnetic circuit with the magnet yet large enough to permit sliding movement of the driver coil assembly.

Criteria for selection of suitable coil parameters, and magnetic parameter including the stator assembly and magnet are similar to those of many speaker driver assemblies available today.

The criteria of 2 to 10 watt driver assemblies are suitable for construction of the vibrator units.

Impedance should be kept from 3 to 8 ohms with driving voltages of 0.5 to 8 volts RMS being sufficient to attain suitable vibration from each vibrator unit.

The stator casings can be ½ to 2 inches wide though other dimensions are possible. Exciter plates can be double or greater diameter than the stator casings. The height of the stator casing should be less than its width.

In operation an A.C. or pulse voltage is applied to the lead in wires of the driver coil (1) causing corresponding fluctuations of magnetic field which react upon the magnetic field of the magnet (5) producing a correspondingly fluctuating force which is transmitted to the exciter plates as mechanical vibration.

This force is transmitted to the material (10) in which the vibrator units are embedded, a thick foam rubber, plastic urethane or other resilient material being suitable provided when in use the individual vibrator units are not felt as lumps within the embedding material, a dense foam is indicated. The foam transmits the vibrational energy to the body.

FIGS. 2*a*, *b*; 3*a*, *b*; 4*a*, *b* illustrate typical embedding configurations such as a mat, cushion or seat especially a car seat.

In a car seat the vibrators may be placed in positions corresponding to the thighs, pelvis, lower back and shoulders to relieve driving fatigue when activated.

Power Supply

The simplest power supply useable for driving a device incorporating one or more vibrator units is an A.C. line operated transformer with a low voltage secondary winding. If no voltage output regulation is used then maximum voltage and power rating must be selected so as not to cause the vibrator units power rating to be exceeded. Voltage output control can be achieved for example, by means of SCR variable phase switching circuitry similar to light dimmers in residential use. However, the frequency would be the line frequency.

Variable frequency operation may be achieved by use of tunable oscillator circuits like audio oscillators incorporating a controllable power amplification output stage. In this instance the output would be controllable by the user in frequency and voltage. To avoid excessive dissipation in the vibrator units the maximum output power should be selected with reference to the number, power rating, and means of connection, (14) if series parallel or a combination of both of the vibrator units. Care should be taken to reduce or eliminate a D.C. voltage output to prevent excessive power dissipation which would not produce vibration of the vibrator units.

A pulse type output power supply could be used for instance, a controllable variable frequency, variable duty cycle astable multivibrator with a controllable power output. This system could provide the lightest weight unit for portable operation from conventional batteries.

Either of the last two systems can be desired to operate from batteries or A.C. or both. A.C. line operated systems require rectification to produce D.C. for use by the oscillator or multivibrator, while battery power can be used as a direct input to the oscillator or multivibrator.

In addition a power supply producing an output which cyclically varies in frequency in the frequency range disclosed would combine the advantages of high and low frequency operation without the user needing to select the frequency of operation.

The D.C. operated systems can be used for cushions or mats used portably in the home or as a beach mat, or could be used in a motor vehicle over the seat, the vibrator units can be embedded in the seat, the power supply drawing its electricity from the motor vehicle D.C. supply.

While the preferred embodiments of this invention have been described and illustrated, various modifications or alterations may be undertaken by those persons skilled in the art without departing from the spirit and scope of the invention as defined in the following claims.

What is claimed is:

1. In an electrically powered vibrator massage therapeutic device the combination of a resilient supporting material encasing and supporting a plurality of electrically operable vibrator units the frequency of mechanical vibration of which is substantially the same as the frequency of electrical voltage applied thereto by an electrical power supply, and electrical power supply as aforesaid, the output voltage of which varies cyclically with time in accordance with the setting of preselectable control means, the power output of which is preselectable between a low level and the maximum allowable dissipation of the combination of vibrator units within the vibrator massage therapeutic device, the electrical power supply driving the said vibrator units; said vibrator unit including a stator having a permanent magnet with longitudinally oriented magnetic poles and stator casing of magnetically permeable material providing a return magnetic path for magnetic flux from one pole of the magnet to the other a driver coil assembly comprising a multiturn coil mounted on a tube which is adapted to vibrate with little friction longitudinally along the pole axis of the permanent magnet, the driver coil assembly remaining substantially within the stator, the outer surface of the coil assembly being of low friction material permitting substantially free vibration in cooperation with the inner liner of the stator casing, the upper section of the coil assembly being attached to a substantially rigid thin mechanical excitation plate wider than the stator casing, a flexible resilient material preventing contact of excitation plate and stator casing, a second mechanical excitation plate attached to the underside of the stator unit, the electrical excitation by time varying electrical power causing the driver coil assembly to vibrate correspondingly along the longitudinal magnetic axis.

2. A vibrator massage therapeutic device as claimed in claim 1 in which the output of the electrical power supply is pulsating, the frequency and duty cycle of pulsation, and magnitude of which is preselectable by control means integral therewith.

3. A vibrator massage therapeutic device as claimed in claim 1 deriving its source of electrical energy from direct current electrical source.

4. A vibrator massage device as claimed in claim 1 in which the device is incorporated in a cushion capable of being placed in contact with the body of the user or thereunder.

5. A vibrator massage device as claimed in claim 1 in which the device is incorporated into a mat of resilient material capable of being rolled or folded for portability.

6. A vibrator massage device as claimed in claim 1 in which the device is incorporated into the cushions of seating devices such as couches or seats or beds.

* * * * *